US008727527B2

(12) United States Patent
Horikawa

(10) Patent No.: US 8,727,527 B2
(45) Date of Patent: May 20, 2014

(54) RECORDING DEVICE

(75) Inventor: Hideshi Horikawa, Kyoto (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 13/156,604

(22) Filed: Jun. 9, 2011

(65) Prior Publication Data

US 2011/0316951 A1 Dec. 29, 2011

(30) Foreign Application Priority Data

Jun. 29, 2010 (JP) ..... 2010-147734

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

| | | | | |
|---|---|---|---|---|
| 5,373,314 | A * | 12/1994 | Everett et al. | 347/71 |
| 2001/0021334 | A1 | 9/2001 | Fujiwara | |
| 2004/0150703 | A1 * | 8/2004 | Nojima et al. | 347/104 |
| 2007/0291096 | A1 * | 12/2007 | Toyoshima | 347/104 |

FOREIGN PATENT DOCUMENTS

| | | | |
|---|---|---|---|
| JP | 02-086476 | A | 3/1990 |
| JP | 11-216932 | A | 8/1999 |
| JP | 2001-130093 | A | 5/2001 |
| JP | 2003-145899 | A | 5/2003 |
| JP | 2005-062736 | A | 3/2005 |

* cited by examiner

*Primary Examiner* — Stephen Meier
*Assistant Examiner* — Alexander C Witkowski
(74) *Attorney, Agent, or Firm* — Global IP Counselors, LLP

(57) ABSTRACT

A recording device includes a device body, a roll accommodating unit accommodating a roll that is a long recording medium wound up into a roll shape, the roll accommodating unit being provided to an exterior of the device body, a recording head that performs recording on the recording medium unwound and conveyed from the roll accommodated in the roll accommodating unit, an ejection conveying unit that ejects the recording medium subjected to recording by the recording head out of the device body, and a carrying unit on which the recording medium ejected by the ejection conveying unit is carried. The carrying unit is formed by a top surface of the device body and a topside surface in a vertical direction of the roll accommodating unit.

6 Claims, 3 Drawing Sheets

RECORDING DEVICE

CROSS-REFERENCE TO RELATED APPLICATIONS

This application claims priority to Japanese Patent Application No. 2010-147734 filed on Jun. 29, 2010. The entire disclosure of Japanese Patent Application No. 2010-147734 is hereby incorporated herein by reference.

BACKGROUND

1. Technical Field

The present invention relates to a recording device.

2. Related Art

In conventional practice, one type of a recording device is a printer that uses a roll in which a rectangular recording medium is wound up into a roll shape in order to continuously perform recording (Japanese Laid-Open Patent Publication No. 2003-145899, for example).

The printer disclosed in Japanese Laid-Open Patent Publication No. 2003-145899 comprises a mounting part for rotatably holding the roll, and a recording head for performing recording on a recording medium being conveyed. Recording is performed by the recording head while the recording medium unwound from the roll held in the mounting part is being conveyed through a conveying route.

SUMMARY

In the recording device of Japanese Laid-Open Patent Publication No. 2003-145899, the recording medium on which recording is performed is ejected out of the recording device from an ejection port formed on a second side surface, which is on the opposite side of first side surface where the roll mounting part is provided in the recording device. Therefore, when a carrying tray or the like for carrying the recording medium ejected from the ejection port is installed next to the second side surface where the ejection port of the recording device is formed, a problem is encountered in which the surface area over which the entire recording device including the carrying tray is installed is very large in relation to the conveying direction of the recording medium.

The present invention was devised in view of the problems described above, and an object thereof is to provide a recording device in which it is possible to minimize the size increase of the device in relation to the conveying direction of the recording medium.

To achieve the object described above, a recording device according to a first aspect of the present invention includes a device body, a roll accommodating unit, a recording head, an ejection conveying unit and a carrying unit. The device body has a box shape. The roll accommodating unit is configured and arranged to accommodate a roll that is a long recording medium wound up into a roll shape, the roll accommodating unit being provided to an exterior of the device body. The recording head is configured and arranged to perform recording on the recording medium unwound from the roll accommodated in the roll accommodating unit and conveyed from an upstream side to a downstream side in a conveying direction. The recording head is provided inside the device body. The ejection conveying unit is configured and arranged to reverse the recording medium recorded by the recording head and to eject the recording medium from the device body. The carrying unit is a unit on which the recording medium ejected by the ejection conveying unit is carried in a reversed state.

The carrying unit is formed by a top surface of the device body and a topside surface in a vertical direction of the roll accommodating unit.

According to this configuration, since the long recording medium recorded on and ejected out of the recording device can be carried over the top surface of the device body and the topside surface in the vertical direction of the roll accommodating unit, there is no need for the carrying tray for carrying the ejected recording medium to be installed so as to be continuous with the device body in the conveying direction of the recording medium. Therefore, the size increase of the recording device in the conveying direction of the recording medium can be minimized.

In the recording device as described above, the roll accommodating unit is preferably disposed so that the topside surface of the roll accommodating unit is positioned lower in the vertical direction than the top surface of the device body.

According to this configuration, between the surfaces that form the carrying surface of the recording medium in the carrying unit onto which the recording medium is ejected, the surface positioned farther downstream than the surface positioned upstream in the ejecting direction of the recording medium is positioned lower in the vertical direction. Therefore, when the long-rectangular recording medium is ejected, the recording medium can move downstream in the ejecting direction due to the weight of the recording medium itself. Therefore, the long recording medium can be ejected smoothly.

In the recording device as described above, a size of the top surface of the device body in a width direction which intersects an ejecting direction in which the recording medium is ejected is preferably greater than a size of the topside surface of the roll accommodating unit in the width direction, and widthwise end portions of the top surface of the device body are extended along the ejecting direction of the recording medium so as to enclose the topside surface of the roll accommodating unit from widthwise sides.

According to this configuration, since the end portions extended in the width direction in the top surface of the device body function as guides for regulating the widthwise position of the recording medium ejected along the ejection route, the long recording medium can be accurately led to the topside surface of the roll accommodating unit and carried.

In the recording device as described above, the roll accommodating unit preferably has a top case that forms the topside surface and a bottom case that is arranged to form an accommodating space for the roll with the top case, and the top case is configured and arranged to turn between a first turning position where the recording medium is carried on the topside surface of the top case due to the top case making contact with the bottom case, and a second turning position which is a positioned state where the accommodating space opens to the exterior due to the top case separating from the bottom case.

According to this configuration, by turning the top case of the roll accommodating unit to the second turning position, the roll accommodated in the roll accommodating unit can be easily replaced. Therefore, by turning the top case between the first turning position and the second turning position, the roll accommodating unit can be made to function as both a carrying unit when the recording medium is being ejected, and an accommodating unit for accommodating the roll, which is the long recording medium wound up into a roll shape, while ensuring that the roll can be easily removed and replaced.

The recording device as described above preferably further includes a regulating unit configured and arranged to regulate a downstream movement of the recording medium. The regulating unit is preferably provided to a position corresponding to a downstream end of an ejection route of the recording medium in the roll accommodating unit.

According to this configuration, when a plurality of long, recording media are stacked on the carrying unit, the carried recording media are restrained from moving further downstream in the ejection route along with the movement of the recording media being ejected. Therefore, the carried recording media can be restrained from falling down from the downstream side of the ejection route.

In the recording device as described above, the top surface of the device body preferably includes a concave groove extending along a direction intersecting an ejecting direction in which the recording medium is ejected, the concave groove being formed in a position which is downstream in the ejecting direction than an ejection port from which the recording medium is ejected in the top surface of the device body, and which is upstream from a position where a distal end in the ejecting direction of the recording medium ejected from the ejection port comes in contact with the top surface of the device body.

According to this configuration, the recording medium carried on the top surface of the device body can be easily removed from the carrying unit.

BRIEF DESCRIPTION OF THE DRAWINGS

Referring now to the attached drawings which form a part of this original disclosure.

DETAILED DESCRIPTION OF EXEMPLARY EMBODIMENTS

An embodiment in which the present invention is specified as an inkjet printer, which is a type of a recording device, is described hereinbelow according to FIGS. 1 through 3. In the following description, when a "forward-backward direction," an "up-down direction," and a "left-right direction" are mentioned, as long as there is no other particular description, they are referring respectively to the "forward-backward direction," the "up-down direction," and the "left-right direction" shown by the arrows in FIG. 1. In the present embodiment, the up-down direction is defined as the same direction as a vertical direction (the direction of gravity).

Figure 1A:
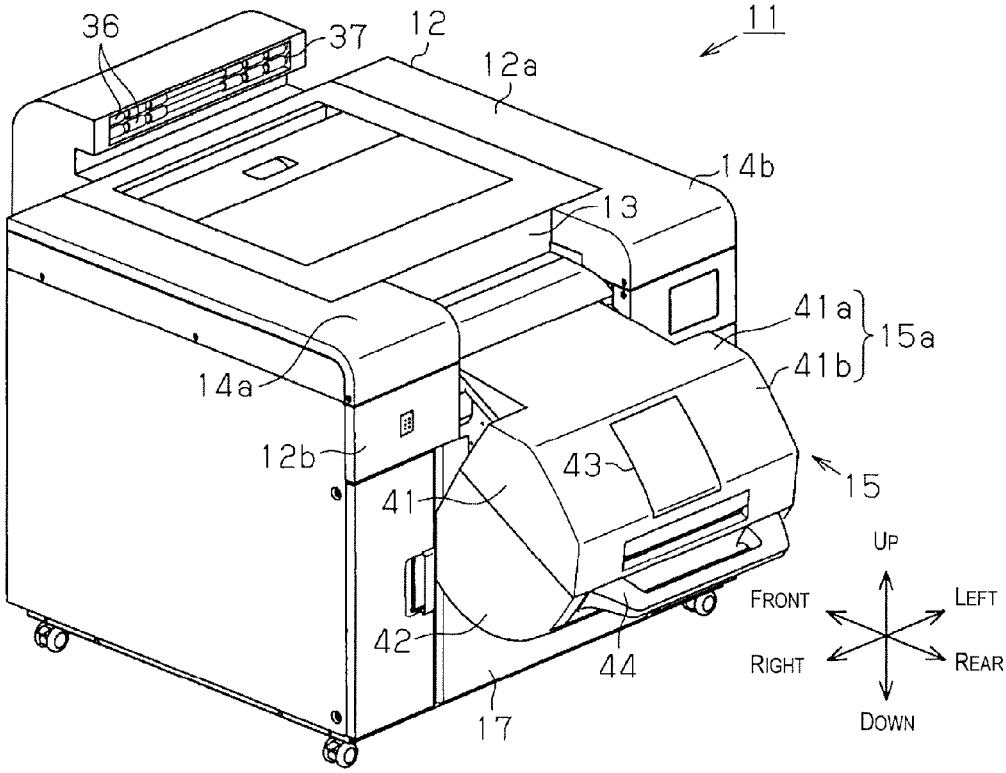
FIG. 1A is a perspective view of an inkjet printer in the present embodiment.
Figure 1B:
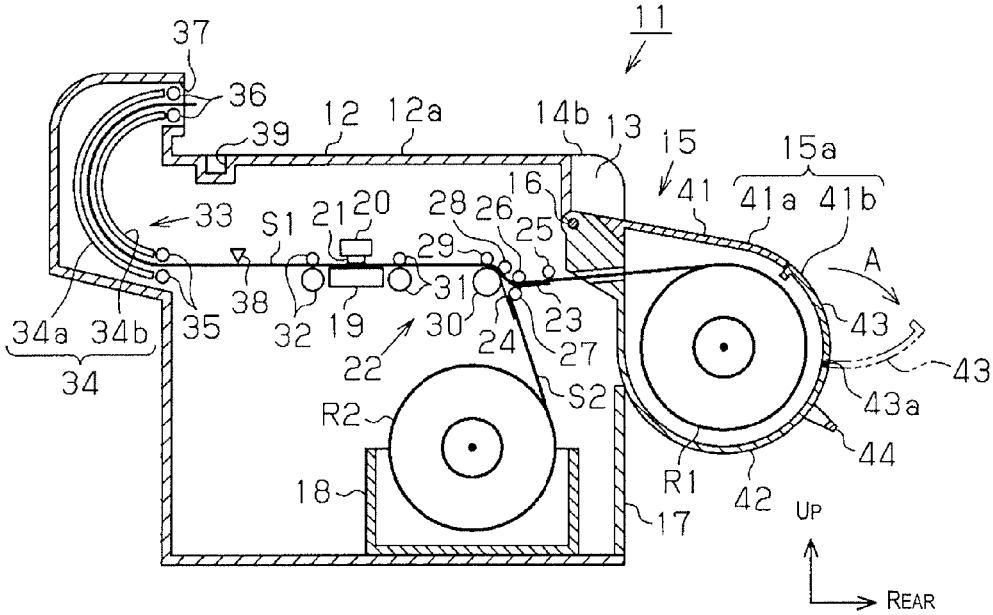
FIG. 1B is a schematic cross-sectional view of the same recording device in FIG. 1A.
Figure 2A:
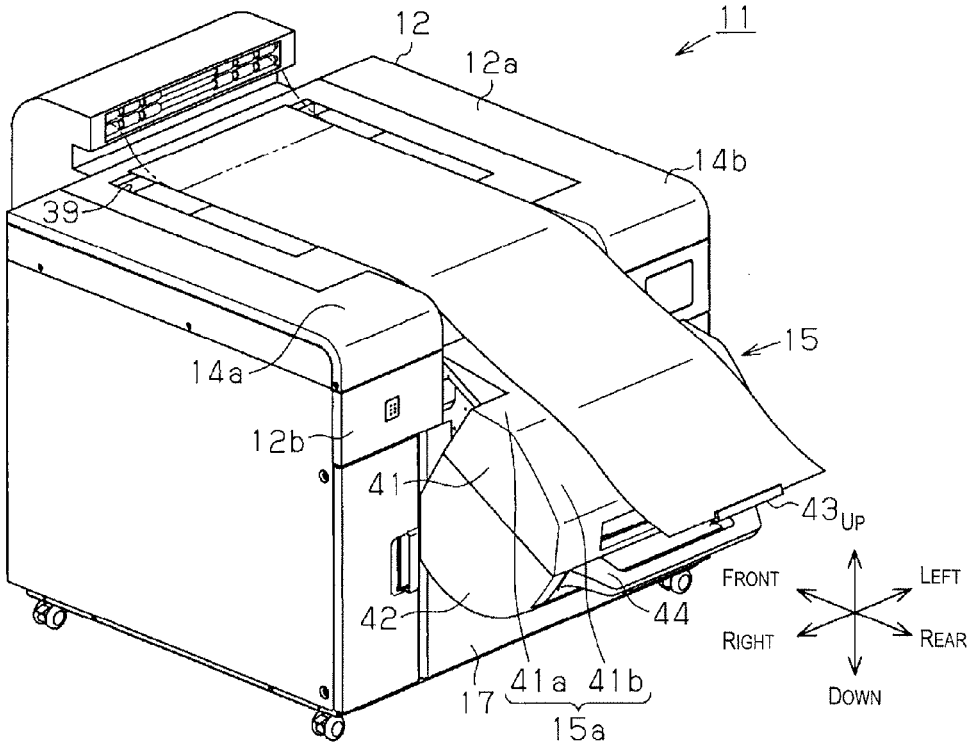
FIG. 2A is a perspective view of the same recording device showing a state in which the sheet is being carried.

An inkjet printer (hereinbelow also referred to as a "printer") 11 comprises a device body 12 having the shape of a box, as shown in FIGS. 1 and 2. A top surface 12*a* of the device body 12 is formed so as to have a substantially rectangular flat surface, and in the substantial center of the corner extending in the left-right direction where the top surface 12*a* and a rear side surface 12*b* intersect, a concave part 13 is recessed so as to open into both the top surface 12*a* and the rear side surface 12*b*, as shown in FIG. 1A. Specifically, the top surface 12*a* of the device body 12 is formed so that adjacent to the rear side surface 12*b*, the ends of the top surface in the width direction (the left-right direction) enclose the concave part 13 from the left and right sides and form extended parts 14*a*, 14*b* extending along the ejecting direction of a sheet S.

In a position corresponding to the concave part 13 in the left-right direction in the rear side surface 12*b* of the device body 12, a roll accommodating unit 15 capable of accommodating a roll R1 in an accommodating space formed in its interior is turnably attached via a turning shaft 16, the roll R1 being a sheet S configured as continuous paper or another long recording medium wound into a roll shape. Specifically, the roll accommodating unit 15 is always disposed on the outer side of the device body 12 so that a topside surface 15*a*, which is the top side of the roll accommodating unit 15 in the vertical direction (the up-down direction), is lower in the up-down direction than the top surface 12*a* of the device body 12, as shown in FIGS. 1 and 2. The roll R1 accommodated in the accommodating space rotates around an axis, whereby the sheet 51 is unwound and conveyed downstream in the conveying direction from the roll accommodating unit 15.

An opening/closing lid 17 formed into a rectangular plate shape and capable of opening and closing is provided to the bottom of the rear side surface 12*b* of the device body 12. In a low position inside the device body 12 and on the inner side of the opening/closing lid 17, a tray 18 is disposed which, similar to the roll accommodating unit 15, accommodates a roll R2 which is a long sheet S2 wound into a roll shape. This tray 18 is configured so as to be removed from of the device body 12 by moving in a direction (the forward-backward direction) intersecting the vertical direction (the up-down direction). The roll R2 accommodated in the tray 18 rotates about an axis, whereby the sheet S2 is unwound and conveyed downstream in the conveying direction from the tray 18.

In a position above the tray 18 within the device body 12, a flat plate-shaped support plate 19 is disposed which is capable of supporting the sheet S1 and the sheet S2 (hereinafter referred to collectively as the "sheet S") unwound and conveyed from the roll R1 and the roll R2 (hereinafter indicated collectively as the "rolls R"), as shown in FIG. 1B. Above the support plate 19 in a position corresponding to the support plate 19, there is provided a carriage 20 which can be moved back and forth in a direction (the left-right direction) intersecting the conveying direction of the sheet S by movement means (not shown). A recording head 21 is supported on the bottom surface of the carriage 20. The bottom surface of the recording head 21 is a horizontal nozzle formation surface in which a plurality of nozzles (not shown) for ejecting ink are opened. The recording head 21 performs recording by ejecting ink onto the sheet S conveyed over the support plate 19.

Inside the device body 12, a conveying mechanism 22 is provided for conveying the sheet S over the support plate 19 along the conveying route, the sheet S having been unwound from the rolls R accommodated in the roll accommodating unit 15 and the tray 18. The conveying mechanism 22 comprises a first receiving plate 23 for receiving the sheet S1 unwound from the roll R1 of the roll accommodating unit 15 along the conveying route, and a second receiving plate 24 for receiving the sheet S2 unwound from the roll R2 of the tray 18 along the conveying route. The conveying mechanism 22 comprises a plurality of conveying rollers 25 to 30 and conveying roller pairs 31, 32 which are set up along the conveying routes of the sheet S1 and the sheet S2 and which convey the sheet S1 and the sheet S2 to the support plate 19. The conveying mechanism 22 is designed to switch between the conveying route of the sheet S1 and the conveying route of the sheet S2 and convey either sheet to the support plate 19.

Furthermore, inside the device body 12, an ejection conveying mechanism 33 for ejecting the sheet S subjected to recording by the recording head 21 out of the device body 12. The ejection conveying mechanism 33 comprises a reversing part 34 for reversing the sheet S subjected to recording by the recording head 21, and conveying roller pairs 35, 36 for conveying the sheet S. The reversing part 34 is configured by two guiding plates 34*a*, 34*b* having substantially arc-shaped cross sections, and the guiding plates 34*a*, 34*b* are arranged in parallel at a gap from each other in the forward-backward direction. Specifically, a curved reversing route is formed between the two guiding plates 34*a*, 34*b*. The guiding plates 34*a*, 34*b* are disposed so that the top end portions of the guiding plates 34*a*, 34*b* are positioned higher in the up-down direction than the top surface 12*a* of the device body 12. The conveying roller pair 35 is disposed in a position corresponding to the upstream end of the reversal route in the reversing part 34. The conveying roller pair 36 is disposed in a position corresponding to the downstream end of the reversing route. Specifically, the conveying roller pair 36 is disposed higher in the up-down direction than the top surface 12*a* of the device body 12.

Having been recorded on by the recording head 21, the sheet S is conveyed downstream and passed through the reversal route of the reversing part 34, whereby its front and back surfaces are reversed. The reversed sheet S is ejected toward the rear of the device body 12 where the roll accommodating unit 15 is attached from an ejection port 37 positioned in the front of the device body 12 above the top surface 12*a*. In this respect, the ejection conveying mechanism 33 functions as an ejection conveying means for reversing and ejecting the sheet S (the recording medium) out of the device body 12 after the sheet has been subjected to recording by the recording head 21. The ejected sheet S is then carried over the topside surface 15*a* of the roll accommodating unit 15 from the top surface 12*a* of the device body 12 while the recording surface on which the ink is deposited faces downward (in the direction of gravity) as shown in FIG. 2. Specifically, the top surface 12*a* of the device body 12 and the topside surface 15*a* of the roll accommodating unit 15 constitute a carrying unit on which the long sheet S (the recording medium) is carried in a reversed state.

In a position downstream from the conveying roller pair 32 in the conveying route of the sheet S and upstream from the conveying roller pair 35, a cutter 38 is provided which is capable of cutting the sheet S in a direction (the left-right direction) intersecting the conveying direction. Specifically, when the sheet S is cut by the cutter 38 from continuous paper into single sheets, the sheets are conveyed one at a time downstream by the ejection conveying mechanism 33 with each cutting, and the sheets are ejected onto the top surface 12*a* of the device body 12.

Figure 2B:
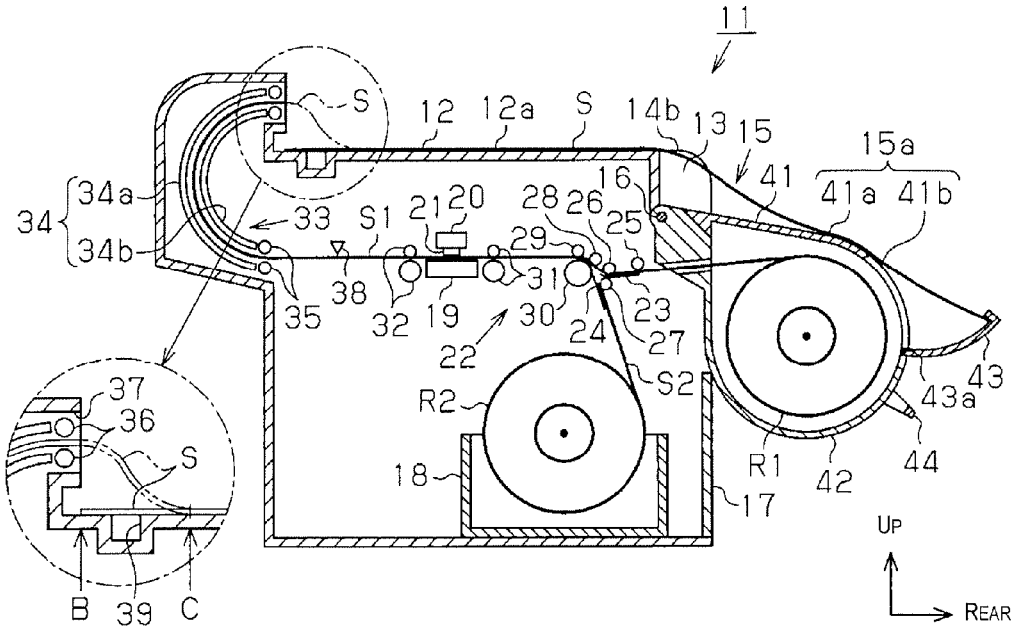
FIG. 2B is a schematic cross-sectional view of the same recording device in FIG. 2A.

A concave groove 39 extending along the width direction (the left-right direction) of the top surface 12*a* is formed in a position farther downstream in the ejection route of the sheet S than the position in the top surface 12*a* of the device body 12 corresponding to the ejection port 37 (the position indicated by the solid-line arrow B in FIG. 2B) and farther upstream than the position where the distal end in the ejection direction of the sheet S ejected from the ejection port 37 comes in contact with the top surface 12*a* (the position indicated by the solid-line arrow C in FIG. 2B). This groove 39 is formed into a substantially rectangular shape in cross section, and its length in the width direction (the left-right direction) is greater than the maximum sheet width of the sheet S. When the sheet S is ejected onto the top surface 12*a* of the device body 12, the sheet S is carried so as to cover up the opening of the groove 39 except for the left and right end portions. Therefore, the user can easily remove the sheet S carried on the top surface 12*a* by inserting their fingers into the groove 39 through the open end portions in the groove 39.

Next, the specific configuration of the roll accommodating unit 15 will be described.

The roll accommodating unit 15 comprises a top case 41 formed into a box shape which forms the topside surface 15*a* of the roll accommodating unit 15 and opens downward, and a bottom case 42 formed into a box shape which opens upward, as shown in FIG. 1. The top case 41 and the bottom case 42 are both capable of turning in the up-down direction about the turning shaft 16, and by coming in contact with each other, the two cases form therein the accommodating space that accommodates the roll R1.

The top case 41 has a first surface 41 a which is inclined slightly rearward and downward from the front side which is the portion in contact with the device body 12, and a second surface 41*b* which is inclined rearward and downward from the rear end of the first surface 41*a*. Specifically, the topside surface 15*a* of the roll accommodating unit 15 is formed by the first surface 41*a* and the second surface 41*b* of the top case 41. In the substantial center of the second surface 41*b*, a stopper 43 is provided as a regulating unit having a substantial L-shape in cross section for regulating the movement of the sheet S downstream in the ejecting direction when the sheet S is carried on the topside surface 15*a* of the roll accommodating unit 15.

The stopper 43 is supported to be capable of turning relative to the top case 41 via a rotating shaft 43*a* provided to one end of the stopper 43. The stopper 43 is designed so as to be displaced between a standby position (the position indicated by the solid lines in FIG. 1B) flush with the second surface 41*b* of the top case 41, and a regulating position (the position indicated by the double-dash lines in FIG. 1B) for regulating the movement of the sheet S. Specifically, the stopper 43 is designed to turn in the direction indicated by arrow A in FIG. 1B. The rear end of the bottom case 42 is provided with a U-shaped handle 44 which extends rearward.

Figure 3A:
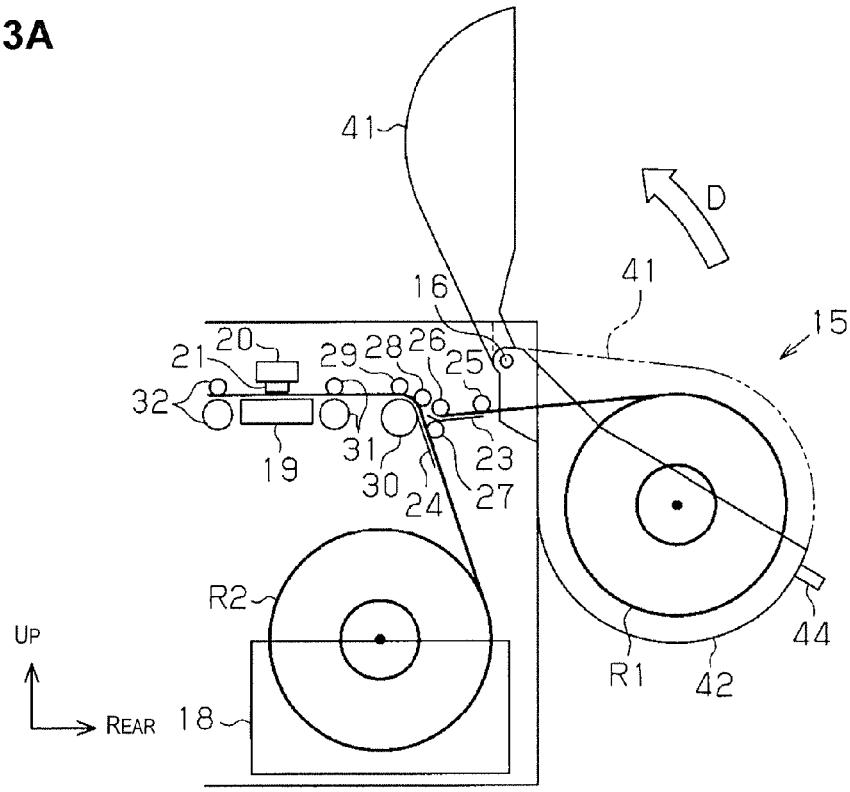
FIG. 3A is a schematic view of the same recording device showing a state in which the top case of the roll accommodating unit is in the second turning position and the bottom case is in the third turning position.

The top case 41 is designed to be displaced between a first turning position (the position indicated by the double-dash lines in FIG. 3A) where it comes in contact with the bottom case 42 below the top surface 12*a* of the device body 12, and a second turning position (the position indicated by the solid lines in FIG. 3A) above the top surface 12*a* of the device body 12 where the top case has separated upward from the bottom case 42, as shown in FIG. 3A. Specifically, the top case 41 is designed to turn in the direction indicated by the white arrow D in FIG. 3A. The accommodating space formed by the top case 41 and the bottom case 42 is opened to the exterior by the top case 41 turning to the second turning position, and the roll R1 accommodated in the accommodating space can easily be replaced with a new roll.

Figure 3B:
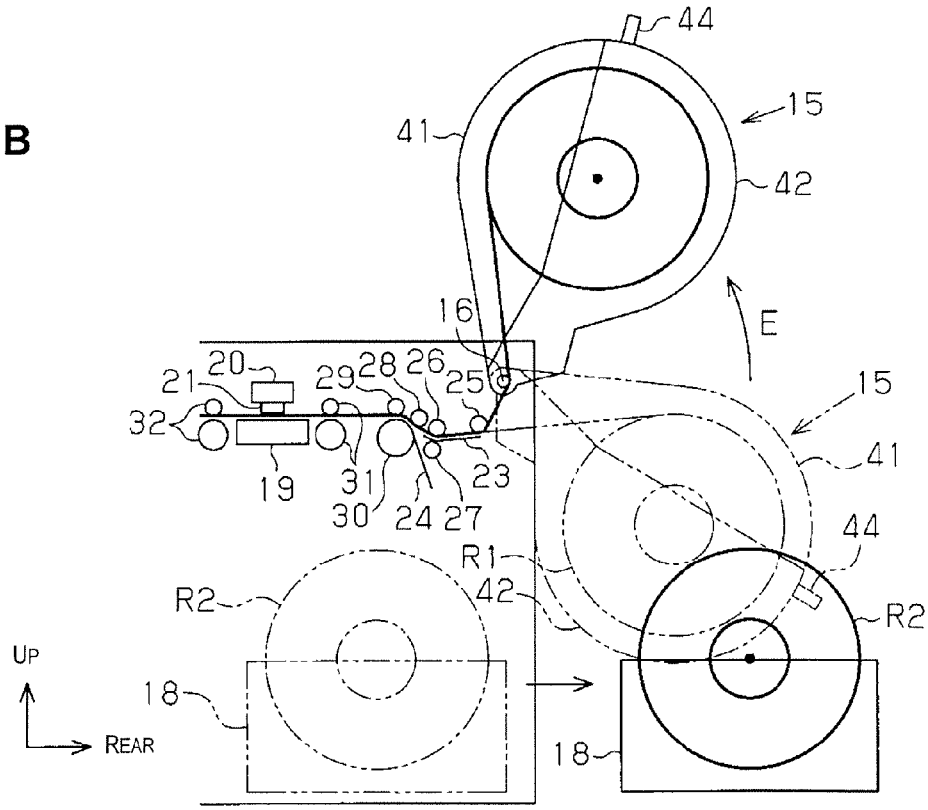
FIG. 3B is a schematic view of the same recording device showing a state in which the top case of the roll accommodating unit is in the second turning position and the bottom case is in the fourth turning position.

The bottom case 42 is designed to be displaced between a third turning position (the position indicated by the double-dashed lines in FIG. 3B) where it comes in contact with the top case 41 below the top end of the opening/closing lid 17, and a fourth turning position (the position indicated by the solid lines in FIG. 3B) wherein comes in contact with the top case 41 at a position above the top end of the opening/closing lid 17, as shown in FIG. 3B. Specifically, the bottom case 42 is designed so as to turn in the direction indicated by the solid arrow E in FIG. 3B. By turning the bottom case 42 to the fourth turning position, the tray 18 disposed inside the device body 12 can be taken out of the device body 12, and the roll R2 accommodated in the tray 18 can be replaced with a new roll.

Next, the action of the printer 11 configured in this mariner will be described with a focus on the ejecting of the sheet S. The sheet S on which recording is performed is supplied from a roll R1 accommodated in the roll accommodating unit 15. When recording is performed, the stopper 43 provided to the roll accommodating unit 15 is displaced to the regulating position.

When the recording process is initiated in the printer 11, for example, the sheet S1 is unwound from the roll R1 accommodated in the roll accommodating unit 15 and conveyed from the upstream side to the downstream side in the conveying direction. When the sheet S1 is then conveyed to a position facing the recording head 21, ink is ejected from the recording head 21 onto the surface of the sheet S1 sliding over the support plate 19. The sheet S1 on which ink is deposited is further conveyed through the reversing part 34 of the ejection conveying mechanism 33. In the reversing part 34, the front and back surfaces of the conveyed sheet S1 are reversed. The sheet S1 whose front and back surfaces have been reversed is then ejected out of the device body 12 through the ejection port 37. The sheet S1 is also cut into single sheets of a predetermined size by the cutter 38.

The sheet S1 ejected from the ejection port 37 is ejected and conveyed along the ejection route over the top surface 12*a* of the device body 12 until the cut rear end of the sheet S1 is ejected out of the device body 12. The groove 39 formed in the top surface 12*a* of the device body 12 is positioned farther upstream than the position where the sheet S1 contacts the top surface 12*a* in the ejection route. Therefore, the distal end of the ejected and conveyed sheet S1 is inhibited from entering and getting stuck in the groove 39.

At the position where the surface over in the ejection route over which the sheet S1 is ejected and conveyed switches from the top surface 12*a* of the device body 12 to the topside surface 15*a* of the roll accommodating unit 15, the extended parts 14*a*, 14*b* in the top surface 12*a* of the device body 12 are disposed so as to enclose the topside surface 15*a* of the roll accommodating unit 15 from both sides in the width direction (the left-right direction). Therefore, when the sheet S1 passes through this position where the ejecting and conveying surface switches from the top surface 12*a* of the device body 12 to the topside surface 15*a* of the roll accommodating unit 15, the widthwise position of the sheet S1 is regulated from the left-right direction by the extended parts 14*a*, 14*b*, and the sheet is accurately led onto the topside surface 15*a* of the roll accommodating unit 15.

The topside surface 15*a* of the roll accommodating unit 15 positioned downstream in the ejection route is positioned below the top surface 12*a* of the device body 12, which is positioned upstream in the ejection route. Therefore, the sheet S1, whose distal end is ejected and conveyed downstream past the top surface 12*a* of the device body 12, moves downstream in the conveying route due to the gravity of the sheet S1 itself (its weight) in addition to the conveying force received from the conveying rollers.

The sheet S1 is carried so as to extend lengthwise from the upstream side to the downstream side in the ejecting direction throughout the top surface 12*a* of the device body 12 and the topside surface 15*a* of the roll accommodating unit 15. In this case, the distal end in the ejecting direction of the carried sheet S1 comes in contact with the stopper 43, and the sheet S1 is therefore restrained by the stopper 43 from moving further downstream in the ejecting direction.

According to the embodiment described above, the following effects can be obtained.

(1) Since the long sheet S recorded on and ejected out of the device body 12 can be carried over the top surface 12*a* of the device body 12 and the topside surface 15*a* on the vertically top side of the roll accommodating unit 15, there is no need for the carrying tray for carrying the ejected sheet S to be installed so as to be continuous with the device body 12 in the conveying direction of the sheet S. Therefore, the size increase of the printer 11 in the conveying direction of the sheet S can be minimized.

(2) Between the top surface 12*a* of the device body 12 and the topside surface 15*a* of the roll accommodating unit 15 onto which the sheet S is ejected, the topside surface 15*a* of the roll accommodating unit 15, which is positioned farther downstream than the top surface 12*a* of the device body 12 positioned upstream in the ejection route of the sheet S, is positioned lower in the vertical direction. Therefore, when the long-rectangular sheet S is ejected, the sheet S can move downstream in the ejecting direction due to the gravity of the sheet S itself. Therefore, the long sheet S can be ejected smoothly.

(3) Since the extended parts 14*a*, 14*b* extended in the top surface 12*a* of the device body 12 function as guides for regulating the widthwise position of the sheet S ejected along the ejection route, the long sheet S can be accurately led to the topside surface 15*a* of the roll accommodating unit 15 and carried.

(4) By turning the top case 41 of the roll accommodating unit 15 to the second turning position, the roll R1 accommodated in the roll accommodating unit 15 can be easily replaced. Therefore, by turning the top case 41 between the first turning position and the second turning position, the roll accommodating unit 15 can be made to function as both a carrying unit when the sheet S is being ejected, and an accommodating unit for accommodating the roll R1, which is the long sheet S1 wound up into a roll shape, while ensuring that the roll R1 can be easily removed and replaced.

(5) When a plurality of long sheets S are stacked on the top surface 12*a* of the device body 12 and the topside surface 15*a* of the roll accommodating unit 15, the carried sheets S are restrained by the stopper 43 from moving further downstream in the ejection route along with the movement of the sheets S being ejected. Therefore, the carried sheets S can be restrained from falling down from the downstream side of the ejection route.

(6) Since the concave groove 39 is formed in the top surface 12*a* of the device body 12, the user can easily remove the sheet S carried on the top surface 12*a* of the device body 12.

The embodiment described above may be modified as follows.

The embodiment described above is configured so that the roll R2 is provided inside the device body 12 and the sheet S is supplied from the roll R2, but the roll R2 need not be provided inside the device body 12.

The recording head 21 is not limited to a serial type head which ejects ink while moving back and forth along the conveying plane of the sheet S1, and may be a line head type or the like extending in the width direction of the sheet S, for example.

The ejection port 37 is not limited to being positioned above the top surface 12*a* of the device body 12, and may be provided in the top surface 12*a*, for example.

The reversing part 34 is not limited to being configured from the guiding plates 34*a*, 34*b*, and may be configured from conveying rollers, for example. The ejection conveying mechanism 33 may also be provided outside of the device body 12.

The top surface 12*a* of the device body 12 has the extended parts 14*a*, 14*b*, but need not have the extended parts 14*a*, 14*b*. A regulating member for regulating the widthwise position of the sheet S on the top surface 12*a* may also be provided.

The groove 39 is not limited to having a substantially rectangular shape in cross section, and may have a circular cross section, a U-shaped cross section, or a V-shaped cross section, for example. A plurality of grooves 39 may also be provided to the top surface 12*a* of the device body 12. The top surface 12*a* of the device body 12 also need not be provided with a groove 39.

The stopper 43 need not be formed so as to be flush with the second surface 41*b* of the top case 41. It also need not be capable of turning. The stopper may also be configured so as to be capable of being removed. Furthermore, the stopper 43 need not be provided to the roll accommodating unit 15.

The roll accommodating unit 15 is not limited to being configured so that the top case 41 and the bottom case 42 can both turn, and the top case 41 alone may turn. The roll accommodating unit 15 also need not turn.

The topside surface 15*a* of the roll accommodating unit 15 is not limited to being configured from two surfaces, the first surface 41*a* and the second surface 41*b*, and may be configured from a single surface. The first surface 41*a* and the second surface 41*b* are also not limited to being inclined rearward and downward, and may be parallel to the top surface 12*a* of the device body 12, for example. These surfaces may also be inclined rearward and upward.

In the embodiment described above, the recording device is specified as an inkjet printer 11, but a recording device which ejects or discharges another liquid other than ink may also be used. The recording device can be applied as various recording devices which comprise a recording head or the like for discharging extremely small droplets. The term "droplets" refers to the state of the liquid discharged from the recording device, and includes materials that leave trails of grains, tears, or threads. The liquid referred to herein need only be a substance that can be ejected by the recording device. For example, the material need only be in the state of a liquid which includes not only fluids such as liquids of high and low viscosity, sols, gels, other inorganic solvents, organic solvents, solutions, liquid resins, and liquid metals (metal melts); and liquids as one state of the substance; but also includes liquids containing particles of functional materials composed of pigments, metal particles, or the like which are dissolved, dispersed, or mixed in a solvent. Typical examples of the liquids include ink such as the ink described in the embodiment described above, liquid crystal, and the like. The term "ink" used herein includes common water-based ink and oil-based ink, as well as gel ink, hot melt ink, and other various liquid compositions. Specific examples of the recording device include recording devices which eject a liquid containing an electrode material, a coloring material, or the like in the form of a dispersion or a solvent, which is used in the manufacture of liquid crystal displays, EL (electroluminescence) displays, surface-emitting displays, color filters, and the like, for example; recording devices which eject a biological organic substance used to manufacture biochips; recording devices which are used as precision pipettes and which eject a liquid as a test sample; printing devices, micro dispensers; and the like. Further options which may be used include recording devices which eject lubricating oil at pinpoints onto watches, cameras, and other precision instruments; recording devices for ejecting an ultraviolet curing resin or another transparent resin liquid onto a substrate in order to form a microscopic semispherical lens (optical lens) or the like used in an optical communication element or the like; and recording devices for ejecting an acid, an alkali, or another etching liquid in order to etch a substrate or the like. The present invention can be applied to any one of these types of recording devices.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a device body having a box shape, the device body further having a first side part, a second side part, and a top surface, the first side part being disposed at a first side of the device body, the second side part being disposed at a second side of the device body and disposed apart from the first side part, the first side part and the second side part extending substantially parallel with respect to each other, the top surface extending substantially perpendicular to the first side part between the first side part and the second side part;

a roll accommodating unit configured and arranged to accommodate a roll that is a long recording medium wound up into a roll shape, the roll accommodating unit being provided to an exterior of the first side part of the device body;

a recording head configured and arranged to perform recording on the recording medium unwound from the roll accommodated in the roll accommodating unit and conveyed from an upstream side to a downstream side in a conveying direction, the recording head being provided inside the device body;

an ejection conveying unit configured and arranged to reverse the recording medium recorded by the recording head and to eject the recording medium from the device body, the ejection conveying unit being disposed on the second side part of the device body; and a carrying unit on which the recording medium ejected by the ejection conveying unit is carried in a reversed state, the carrying unit being formed by the top surface of the device body and a topside surface in a vertical direction of the roll accommodating unit.

2. The recording device according to claim 1, wherein the roll accommodating unit is disposed so that the topside surface of the roll accommodating unit is positioned lower in the vertical direction than the top surface of the device body.

3. The recording device according to claim 1, wherein a size of the top surface of the device body in a width direction which intersects an ejecting direction in which the recording medium is ejected is greater than a size of the topside surface of the roll accommodating unit in the width direction, and widthwise end portions of the top surface of the device body are extended along the ejecting direction of the recording medium so as to enclose the topside surface of the roll accommodating unit from widthwise sides.

4. The recording device according to claim 1, wherein the roll accommodating unit has a top case that forms the topside surface and a bottom case that is arranged to form an accommodating space for the roll with the top case, and the top case is configured and arranged to turn between a first turning position where the recording medium is carried on the topside surface of the top case due to the top case making contact with the bottom case, and a second turning position which is a positioned state where the accommodating space opens to the exterior due to the top case separating from the bottom case.

5. The recording device according to claim 1, further comprising a regulating unit configured and arranged to regulate a downstream movement of the recording medium, the regulating unit being provided to a position corresponding to a downstream end of an ejection route of the recording medium in the roll accommodating unit.

6. The recording device according to claim 1, wherein the top surface of the device body includes a concave groove extending along a direction intersecting an ejecting direction in which the recording medium is ejected, the concave groove being formed in a position which is downstream in the ejecting direction than an ejection port from which the recording medium is ejected in the top surface of the device body, and which is upstream from a position where a distal end in the ejecting direction of the recording medium ejected from the ejection port comes in contact with the top surface of the device body.

* * * * *